US006325953B1

(12) United States Patent
Murata

(10) Patent No.: US 6,325,953 B1
(45) Date of Patent: Dec. 4, 2001

(54) PLASTIC WORKING METHOD AND PLASTIC WORKING MACHINE

(75) Inventor: Makoto Murata, Yokohama (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 09/251,948

(22) Filed: Feb. 17, 1999

(30) Foreign Application Priority Data

Feb. 18, 1998 (JP) ..... 10-036453

(51) Int. Cl.[7] ..... B21C 37/15; B21C 37/30; B21D 22/14; B29C 67/00

(52) U.S. Cl. ..... 264/40.1; 72/84; 72/370.23; 72/370.26; 264/310; 425/135; 425/168; 425/363; 425/392; 425/394

(58) Field of Search ..... 264/40.1, 310; 425/135, 168, 363, 392, 394; 72/84, 370.23, 370.26

(56) References Cited

U.S. PATENT DOCUMENTS 2,363,507 11/1944 Dewey .
3,444,715 5/1969 Sellars .

FOREIGN PATENT DOCUMENTS 1260814 4/1961 (FR) .
58116925 7/1983 (JP) .
62227520 10/1987 (JP) .
07080556 3/1995 (JP) .

*Primary Examiner*—Leo B. Tentoni

(57) ABSTRACT

There is provided a plastic working machine for plastically working a tube by employing tube holding and spinning means for holding and spinning the plastically workable tube around the axis of the tube and first and second plastic working tools which face to each other so as to pinch the tube in the radial direction of the tube and which are movable along the radial and axial directions of the tube while being pressed against the tube. The plastic working machine executes a step of plastically working the tube by the first and second plastic working tools by continuously spinning the tube around the axis thereof and by applying compressive load or tensile load along the axial direction of the tube to the tube.

20 Claims, 20 Drawing Sheets

PLASTIC WORKING METHOD AND PLASTIC WORKING MACHINE

BACKGROUND OF THE INVENTION

1. Field of the Invention

The present invention relates to a plastic working method and a plastic working machine for plastically working a plastically workable tube by pressing plastic working tools.

2. Description of the Related Art

Hitherto, a spinning work machine as shown in FIG. 18 has been known as one type of plastic working machines. In FIG. 18, the reference numeral 1 denotes a base and 2 a plastically workable tube, i.e., a workpiece, whose sectional profile is circular.

The reference numeral 3 denotes a chuck for clamping and holding the tube 2 by claws and 4 a tube supporting member fixed to the base 1 to rotably support the tube 2 around the axis of the tube 2. The tube 2 is disposed so that the axial direction of the tube 2 coincides with the longitudinal direction of the base 1 by the chuck 3 and the tube supporting member 4.

The reference numeral 5 denotes a stationary stage fixed via two leg members (one leg member 6 is seen in the figure) fixed on the upper surface of the base 1, 7 a motor for spinning the tube 2 around the axis of the tube 2 (in the direction of so-called Z-axis) and 8 a decelerator fixed on the stationary stage 5 to decelerate the rotation of the motor 7. The motor 7 is attached to the decelerators 8.

The reference numeral 9 denotes a rotary shaft of the decelerator 8, and 10 and 11 bearings fixed on the stationary stage 5 to rotably support the rotary shaft 9 of the decelerator 8. The chuck 3 is attached at the end of the rotary shaft 9 of the decelerator 8.

The reference numerals 12 and 13 denote linear way rails provided in parallel on the upper surface of the base 1 so as to extend in the longitudinal direction of the base 1, i.e., in the axial direction of the tube 2, and 14 a movable stage disposed on the linear way rails 12 and 13 so as to be movable along the linear way rails 12 and 13.

The reference numeral 15 denotes a ball screw provided in parallel with the linear way rails 12 and 13 so as to move the movable stage 14 along the linear way rails 12 and 13, and 16 a motor provided on the upper surface of the base 1 to move the movable stage 14 along the linear way rails 12 and 13 via the ball screw 15.

The reference numerals 17 and 18 denote linear way rails provided in parallel on the upper surface of the movable stage 14 so as to extend in the direction of the width of the base 1, and 19 and 20 movable stages disposed on the linear way rails 17 and 18 so as to be movable independently from each other along the linear way rails 17 and 18.

The reference numeral 21 denotes a ball screw provided in parallel with the linear way rails 17 and 18 so as to move the movable stage 19 along the linear way rails 17 and 18, and 22 a ball screw provided in parallel with the linear way rails 17 and 18 so as to move the movable stage 20 along the linear way rails 17 and 18.

The reference numerals 23 and 24 denote motor mounting members fixed to the movable stage 14, 25 a motor mounted to the motor mounting member 23 to move the movable stage 19 along the linear way rails 17 and 18 via the ball screw 21, and 26 a motor mounted to the motor mounting member 24 to move the movable stage 20 along the linear way rails 17 and 18 via the ball screw 22.

The reference numerals 27 and 28 denote plastic working rolls for plastically working the tube 2 by pressing against the tube 2, and 29 and 30 plastic working roll holding members for holding the plastic working rolls 27 and 28. The plastic working roll holding members 29 and 30 are fixed on the upper surface of the movable stages 19 and 20, respectively.

This spinning work machine is constructed as described above to spin and work the tube 2 by continuously spinning the tube 2 around the axis of the tube 2 and by moving the movable stages 19 and 20 symmetrically in the radial direction of the tube 2 or by moving the movable stage 14 in the axial direction of the tube 2 in the same time and by pressing the plastic working rolls 27 and 28 against the tube 2 while controlling the relative position between the plastic working rolls 27 and 28 and the tube 2. It allows tubular members as shown in FIGS. 19A, 19B, 20A and 20B to be fabricated for example.

However, the primary object of the conventional spinning work machine shown in FIG. 18 is to work the external shape of the tube 2 into a predetermined shape and is not provided with means for controlling the thickness of the tubular member fabricated by the spinning.

Therefore, the plastic deformation mechanism is decided univocally by the predetermined shape and the working process in spinning and working the tube 2 into the predetermined shape. As a result, it has had problems that the thickness of each part of the tubular member fabricated by the spinning work is univocally decided and that a tubular member having a desired thickness at each part cannot be fabricated.

For instance, the conventional spinning work machine has had a problem in fabricating a tubular member having an external shape as shown in FIGS. 19A and 19B that thickness of each part becomes thinner than the thickness before the work and that the part around the bottom of the concave portion indicated by an arrow A is thinned in particular, thus weakening the strength of this part most.

It also has had a problem in fabricating a tubular member having an external shape as shown in FIGS. 20A and 20B that the smaller the sectional area, i.e., the closer to the part where the tube should be shrunk more, the thicker the thickness is and that the thickness cannot be fixed.

The conventional spinning work machine shown in FIG. 18 has had another problem that it is unable to fabricate a tubular member having an axially asymmetrical shape because the tube 2 is spun continuously around the axis of the tube 2.

SUMMARY OF THE INVENTION

Accordingly, it is a primary object of the present invention to provide a plastic working method and a plastic working machine which allow a tubular member having a desired thickness to be fabricated by implementing spinning works while controlling the thickness of the tubular member.

It is a secondary object of the invention to provide a plastic working method and a plastic working machine which are arranged so as to be able to fabricate an axially asymmetrical tubular member which could not be fabricated by the conventional spinning work machine.

According to a first aspect of the invention, there is provided a plastic working method for plastically working a tube by employing tube holding and spinning means for holding and spinning the plastically workable tube around the axis of the tube and first and second plastic working tools which face to each other so as to pinch the tube in the radial direction of the tube and which are movable along the radial and axial directions of the tube while being pressed against the tube; wherein the plastic working method comprises a step of plastically working the tube by the first and second plastic working tools by continuously spinning the tube around the axis thereof and by applying compressive load or tensile load along the axial direction of the tube to the tube.

According to the first aspect of the invention, the step of plastically working the tube by the first and second plastic working tools by continuously spinning the tube around the axis thereof and by applying compressive load or tensile load along the axial direction of the tube to the tube is executed, thickness of each part of a tubular member fabricated by the spinning work may be controlled.

It is noted that the thickness of the spinning work part may be thickened when the compressive load along the axial direction of the tube is applied to the tube and the thickness of the spinning work part may be thinned when the tensile load along the axial direction of the tube is applied.

According to a second aspect of the invention, there is provided a plastic working machine comprising tube holding and spinning means for holding and spinning a plastically workable tube around the axis of the tube and first and second plastic working tools which face to each other so as to pinch the tube in the radial direction of the tube and which are movable along the radial and axial directions of the tube while being pressed against the tube; the plastic working machine further comprising load applying means for applying compressive load or tensile load along the axial direction of the tube to the tube.

According to the second aspect of the invention, since the machine comprises the load applying means for applying the compressive load or the tensile load along the axial direction of the tube to the tube, the compressive or tensile load along the axial direction of the tube may be applied to the tube.

Accordingly, the step of plastically working the tube by the first and second plastic working tools by continuously spinning the tube around the axis thereof and by applying the compressive or tensile load along the axial direction of the tube to the tube may be executed, the tube may be worked while spinning it and the thickness of each part of the tube fabricated by the spinning work may be controlled.

According to a third aspect of the invention, there is provided a plastic working method for plastically working a tube by employing a plastic working machine comprising tube holding and spinning means for holding and spinning the plastically workable tube around the axis of the tube and first and second plastic working tools which face to each other so as to pinch the tube in the radial direction of the tube and which are movable along the radial and axial directions of the tube while being pressed against the tube; wherein the method further comprises a step of plastically working the tube by the first and second plastic working tools by holding the tube at a desired turn angle.

According to the third aspect of the invention, the step of plastically working the tube by the first and second plastic working tools while holding the tube at the desired turn angle is executed, so that tubular members having various shapes whose sectional profile is not axially symmetrical such as a tubular member whose sectional profile is polygonal or elliptical, which could not be fabricated by the conventional spinning work method, may be fabricated.

According to a fourth aspect of the invention, there is provided a plastic working machine comprising tube holding and spinning means for holding and spinning a plastically workable tube around the axis of the tube and first and second plastic working tools which face to each other so as to pinch the tube in the radial direction of the tube and which are movable along the radial and axial directions of the tube while being pressed against the tube; wherein the plastic working machine further comprising tube holding and spinning control means for controlling the tube holding and spinning means so as to hold the tube at a desired turn angle.

According to the fourth aspect of the invention, since the machine comprises the tube holding and spinning control means for controlling the tube holding and spinning means so as to hold the tube at a desired turn angle, the step of plastically working the tube by the first and second plastic working tools while holding the tube at the desired angle may be executed.

Therefore, tubular members having various shapes whose sectional profile is not axially symmetrical such as a tubular member whose sectional profile is polygonal or elliptical, which could not be fabricated by the conventional spinning work method, may be fabricated.

According to a fifth aspect of the invention, there is provided a plastic working method for plastically working a tube by employing tube holding and spinning means for holding and spinning the plastically workable tube around the axis of the tube and first and second plastic working tools which face to each other so as to pinch the tube in the radial direction of the tube and which are movable along the radial and axial directions of the tube while being pressed against the tube; wherein the plastic working method comprises a step of plastically working the tube by the first and second plastic working tools by spinning the tube around the axis of the tube and by synchronizing the turn angle of the tube with the position of the first and second plastic working tools in the axial direction of the tube.

According to the fifth aspect of the invention, since the step of plastically working the tube by the first and second plastic working tools by spinning the tube around the axis of the tube and by synchronizing the turn angle of the tube with the position of the first and second plastic working tools in the axial direction of the tube is executed, twisted tubes having various sectional profiles such as a twisted tube whose sectional profile is polygonal, which could not be fabricated by the conventional spinning work machine, can be fabricated.

According to a sixth aspect of the invention, there is provided a plastic working machine comprising tube holding and spinning means for holding and spinning a plastically workable tube around the axis of the tube and first and second plastic working tools which face to each other so as to pinch the tube in the radial direction of the tube and which are movable along the radial and axial directions of the tube while being pressed against the tube; wherein the plastic working machine further comprises synchronization control means for synchronizing the turn angle of the tube with the position of the first and second plastic working tools in the axial direction of the tube.

According to the sixth aspect of the invention, since the machine comprises the synchronization control means for synchronizing the turn angle of the tube with the position of the first and second plastic working tools in the axial direction of the tube, the step of plastically working the tube by the first and second plastic working tools by spinning the tube around the axis thereof and by synchronizing the turn angle of the tube with the position, in the axial direction of the tube, of the first and second plastic working tools may be executed.

Therefore, twisted tubes having various sectional profiles such as a twisted tube whose sectional profile is polygonal, which could not be fabricated by the conventional spinning work machine, may be fabricated.

The above and other objects and advantages of the invention will become more apparent in the following detailed description of the invention described with reference to the accompanying drawings.

BRIEF DESCRIPTION OF THE DRAWINGS

FIGS. 6A and 6B show an example of a tubular member fabricated by spinning a tube whose sectional profile is circular by employing one embodiment of the inventive plastic working machine, in which:

FIG. 6A is a front view of the tubular member; and

FIG. 6B is a section view of the tubular member taken along the line 6B—6B in FIG. 6A;

FIGS. 7A and 7B show an example of a tubular member fabricated by spinning the tube whose sectional profile is circular by employing one embodiment of the inventive plastic working machine, in which:

FIG. 7A is a front view of the tubular member; and

FIG. 7B is a section view of the tubular member taken along the line 7B—7B in FIG. 7A;

FIGS. 19A and 19B show an example of a tubular member fabricated by employing the conventional spinning work machine shown in FIG. 18, in which:

FIG. 19A is a front view of the tubular member; and

FIG. 19B is a section view of the tubular member taken along the line 19B—19B in FIG. 19A; and FIGS. 20A and 20B show another example of a tubular member fabricated by employing the conventional spinning work machine shown in FIG. 18, in which:

FIG. 20A is a front view of the tubular member; and

FIG. 20B is a section view of the tubular member taken along the line 20B—20B in FIG. 20A.

DETAILED DESCRIPTION OF THE PREFERRED EMBODIMENT

One embodiment of an inventive plastic working method and an inventive plastic working machine will be explained below with reference to FIGS. 1 through 17.

Figure 1:
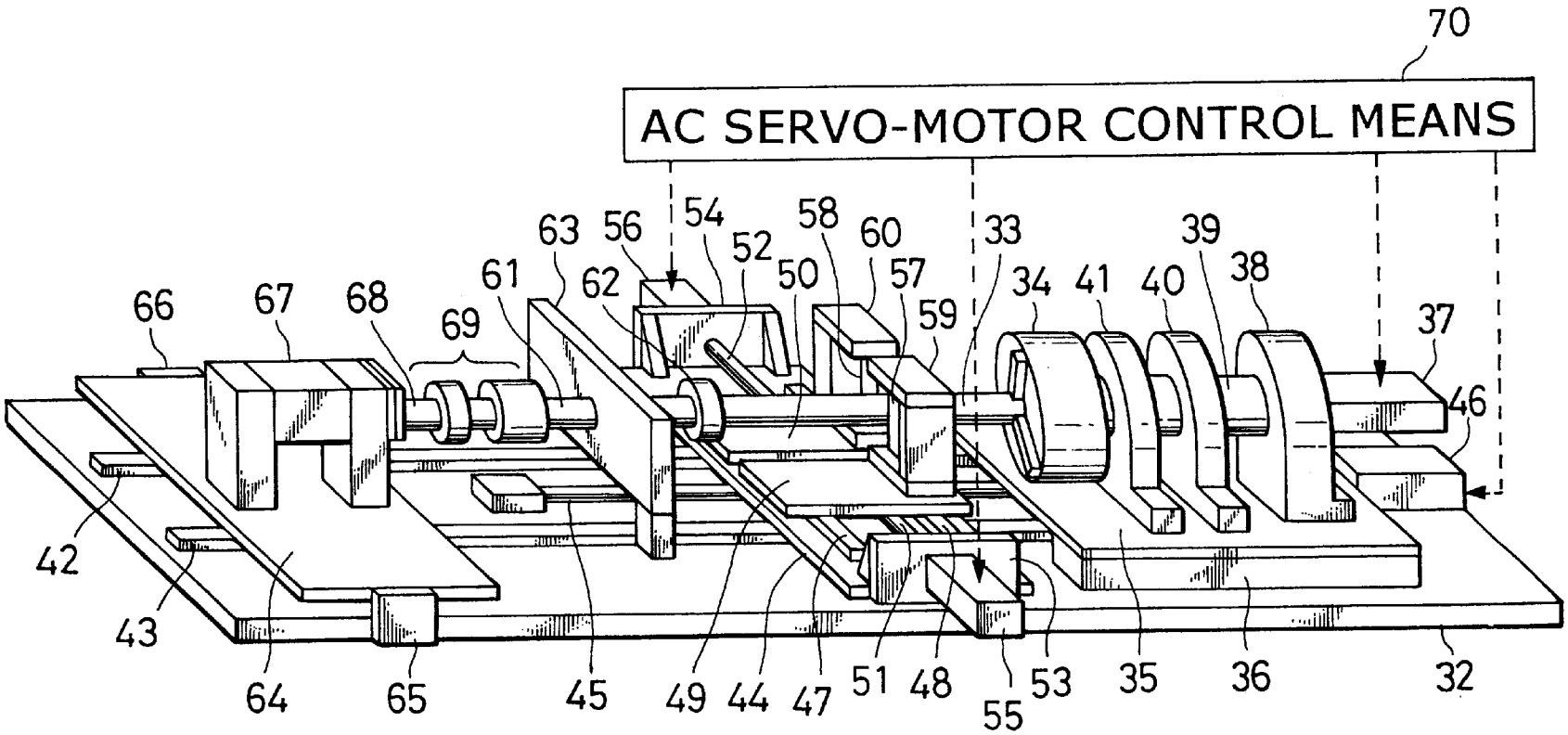
FIG. 1 is a schematic perspective view showing one embodiment of an inventive plastic working machine.

FIG. 1 is a schematic perspective view showing one embodiment of an inventive plastic working machine. In the figure, the reference numeral 32 denotes a base, and 33 a plastically workable tube, i.e., a workpiece, whose sectional profile is circular, and 34 a chuck for clamping and holding the tube 33 by claws.

The reference numeral 35 denotes a stationary stage fixed via two leg members (one leg member 36 is seen in the figure) fixed on the upper surface of the base 32, 37 an AC servo-motor for spinning the tube 33 around the axis of the tube 33 (in the direction of so-called Z-axis).

The reference numeral 38 denotes a decelerator fixed on the stationary stage 35 to decelerate the rotation of the servo-motor 37. The servo-motor 37 is attached to the decelerator 38.

The reference numeral 39 denotes a rotary shaft of the decelerator 38, and 40 and 41 bearings fixed on the stationary stage 35 to rotably support the rotary shaft 39 of the decelerator 38. The chuck 34 is attached at the end of the rotary shaft 39 of the decelerator 38.

The reference numerals 42 and 43 denote linear way rails provided in parallel on the upper surface of the base 32 so as to extend in the longitudinal direction of the base 32, i.e., in the axial direction of the tube 33, and 44 a movable stage disposed on the linear way rails 42 and 43 so as to be movable along the linear way rails 42 and 43.

The reference numeral 45 denotes a ball screw provided in parallel with the linear way rails 42 and 43 so as to move the movable stage 44 along the linear way rails 42 and 43, and 46 an AC servo-motor provided on the upper surface of the base 32 to move the movable stage 44 along the linear way rails 42 and 43 via the ball screw 45.

The reference numerals 47 and 48 denote linear way rails provided in parallel on the upper surface of the movable stage 44 so as to extend in the direction of the width of the base 32, and 49 and 50 movable stages disposed on the linear way rails 47 and 48 so as to be movable independently from each other along the linear way rails 47 and 48.

The reference numeral 51 denotes a ball screw provided in parallel with the linear way rails 47 and 48 so as to move the movable stage 49 along the linear way rails 47 and 48, and 52 a ball screw provided in parallel with the linear way rails 47 and 48 so as to move the movable stage 50 along the linear way rails 47 and 48.

The reference numerals 53 and 54 denote motor mounting members fixed to the movable stage 44, 55 an AC servo-motor mounted to the motor mounting member 53 to move the movable stage 49 along the linear way rails 47 and 48 via the ball screw 51, and 56 an AC servo-motor mounted to the motor mounting member 54 to move the movable stage 50 along the linear way rails 47 and 48 via the ball screw 52.

The reference numerals 57 and 58 denote plastic working rollers for plastically working the tube 33 by pressing to the tube 33, and 59 and 60 plastic working roll holding members for holding the plastic working rolls 57 and 58. These plastic working roll holding members 59 and 60 are fixed on the upper surface of the movable stages 49 and 50, respectively.

The reference numerals 61 denotes a load application auxiliary member used as an auxiliary member in applying compressive load or tensile load to the tube 33 along the axial direction of the tube 33, 62 a fastening member for fastening the load application auxiliary member 61 and the tube 33, and 63 a supporting member for rotably supporting the load application auxiliary member 61.

The reference numerals 64 denotes a movable stage disposed on the linear way rails 42 and 43 so as to movable along the linear way rails 42 and 43, and 65 and 66 fixing members for fixing the movable stage 64 to the base 32 so as to be immovable.

The reference numerals 67 denotes a hydraulic cylinder for producing the compressive load and the tensile load to be applied to the tube 33, 68 a rod provided at the hydraulic cylinder 67 to emerge the compressive load and the tensile load to be applied to the tube 33, and 69 a load transmitting member for transmitting the compressive load and the tensile load which are emerged at the rod 68 to the load application auxiliary member 61.

The reference numerals 70 denotes AC servo-motor control means for controlling the rotation of the AC servo motors 37, 46, 55 and 56 such as start and stop of the spin and a spinning speed thereof, independently from each other.

Figure 2:
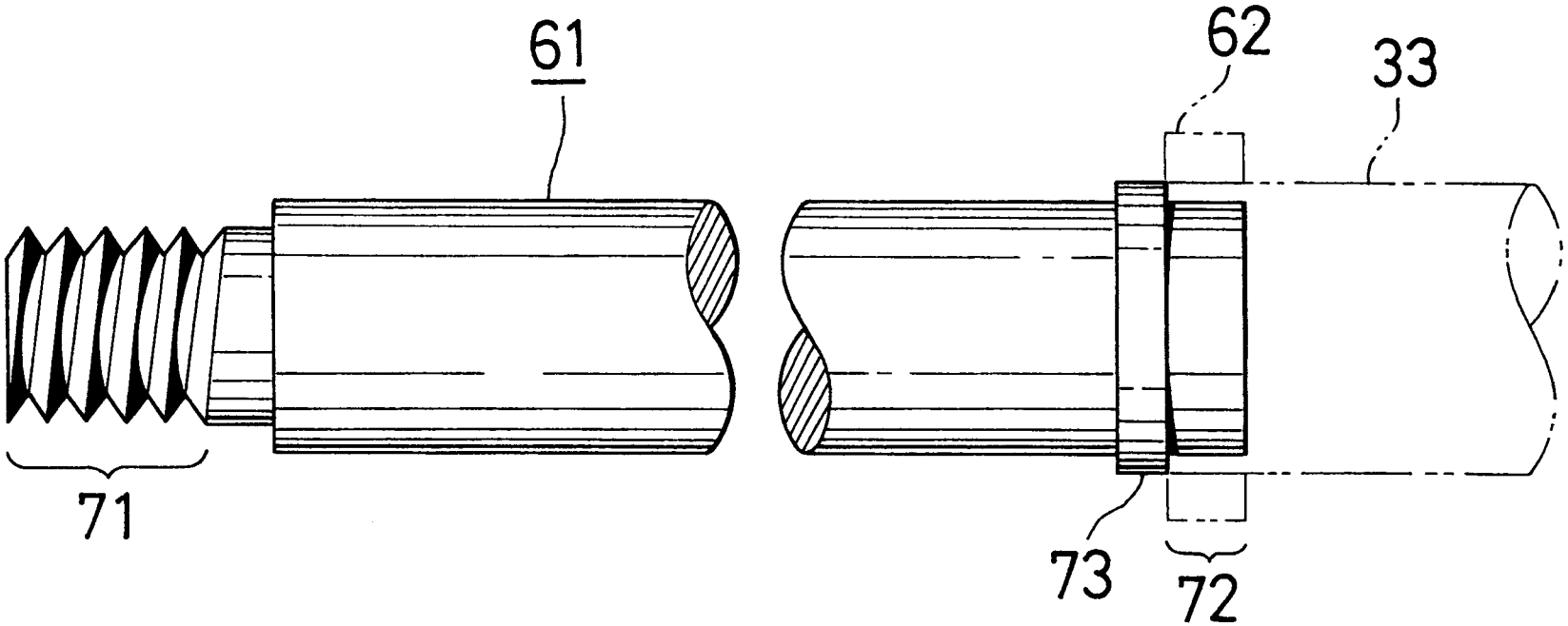
FIG. 2 is a schematic front view of a load application auxiliary member provided in one embodiment of the inventive plastic working machine.

FIG. 2 is a schematic front view of the load application auxiliary member 61. The load application auxiliary member 61 is made from a long cylindrical member on which a male screw section 71 for screwing into the load transmitting member 69 is formed at one end, a tube fitting section 72 for fitting in the tube 33 is formed at the other end and a flange 73 for abutting with the end of the tube 33 is formed adjacent to the fitting section 72.

Figure 3:
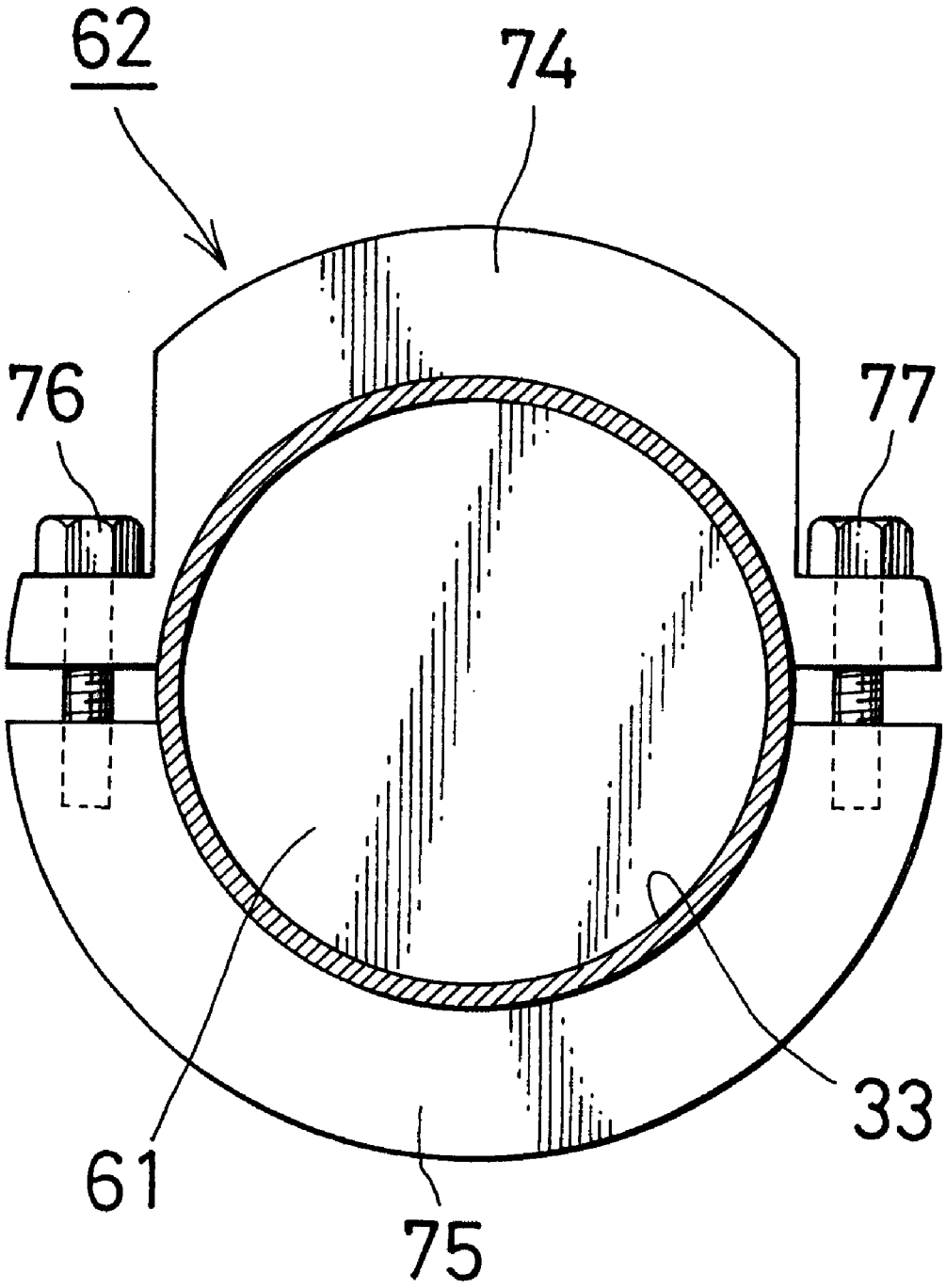
FIG. 3 is a schematic front view of a fastening member provided in one embodiment of the inventive plastic working machine.

FIG. 3 is a schematic front view of the fastening member 62. The fastening member 62 comprises half-ringed members 74 and 75 and bolts 76 and 77 for connecting the half-ringed members 74 and 75 so as to be ringed.

The fastening member 62 fastens the load application auxiliary member 61 and the tube 33 by abutting the inside of the half-ringed members 74 and 75 to the outside of the tube 33 fitted with the load application auxiliary member 61 and by fastening the tube 33 by the half-ringed members 74 and 75 by using the bolts 76 and 77. Accordingly, the load application auxiliary member 61 spins together with the tube 33 when the tube 33 is spun around the axis thereof.

Figure 4:
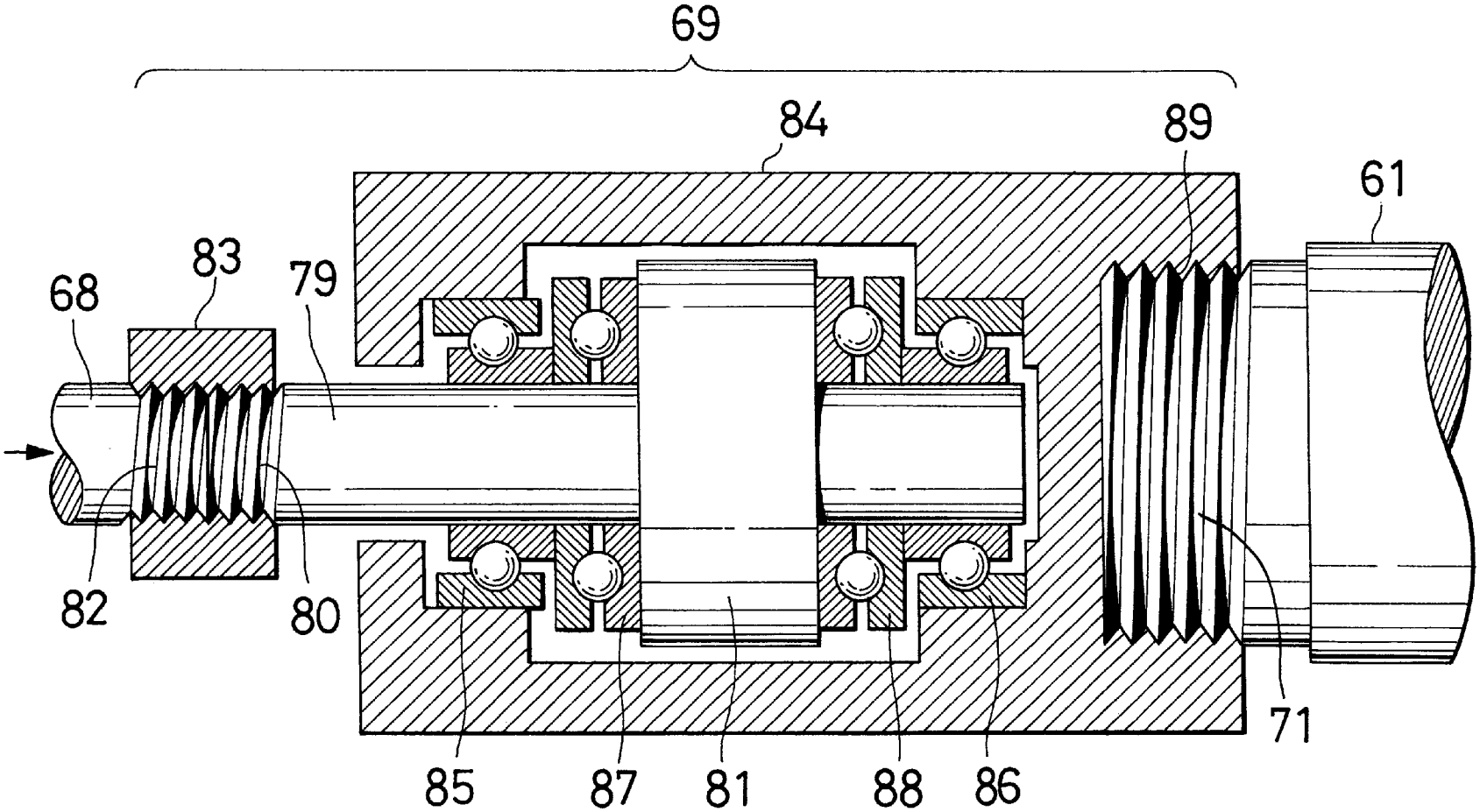
FIG. 4 is a schematic centrally longitudinal end view of a load transmitting member provided in one embodiment of the inventive plastic working machine.

FIG. 4 is a schematic centrally longitudinal end view of the load transmitting member 69. The load transmitting member 69 comprises a loaded load transmitting rod 79 on which a male screw 80 is formed on one end and a flange 81 is formed on the other end. It is noted that a male screw 82 is formed also at the edge of the rod 68.

The reference numeral 83 denotes a nut for connecting the loaded load transmitting rod 79 with the rod 68, 84 a cylinder, and 85 and 86 radial ball bearings interposed between the cylinder 84 and the loaded load transmitting rod 79.

The reference numeral 87 denotes a thrust ball bearing interposed between the flange 81 and the radial ball bearing 85, and 88 a thrust ball bearing interposed between the flange 81 and the radial ball bearing 86.

It is noted that a female screw section 89 for screwing the male screw section 71 of the load application auxiliary member 61 is formed at one end of the cylinder 84. Thus, the cylinder 84 is screwed with the load application auxiliary member 61.

In the load transmitting member 69 constructed as described above, the spin of the cylinder 84 is not transmitted to the loaded load transmitting rod 79 even when the load application auxiliary member 61 is screwed with the cylinder 84 and even when the cylinder 84 spins as the load application auxiliary member 61 is spun by the rotation of the tube 33 because the radial ball bearings 85 and 86 are interposed between the cylinder 84 and the loaded load transmitting rod 79.

Then, when the compressive load is caused to emerge on the rod 68, the flange 81 of the loaded load transmitting rod 79 is press-fitted with the thrust ball bearing 88, the thrust ball bearing 88 is press-fitted with the radial ball bearing 86 and the radial ball bearing 86 is press-fitted with the cylinder 84 as shown in FIG. 4.

Accordingly, the compressive load emerged on the rod 68 may be transmitted to the cylinder 84 via the loaded load transmitting rod 79, the thrust ball bearing 88 and the radial ball bearing 86 and further to the tube 33 via the load application auxiliary member 61.

Figure 5:
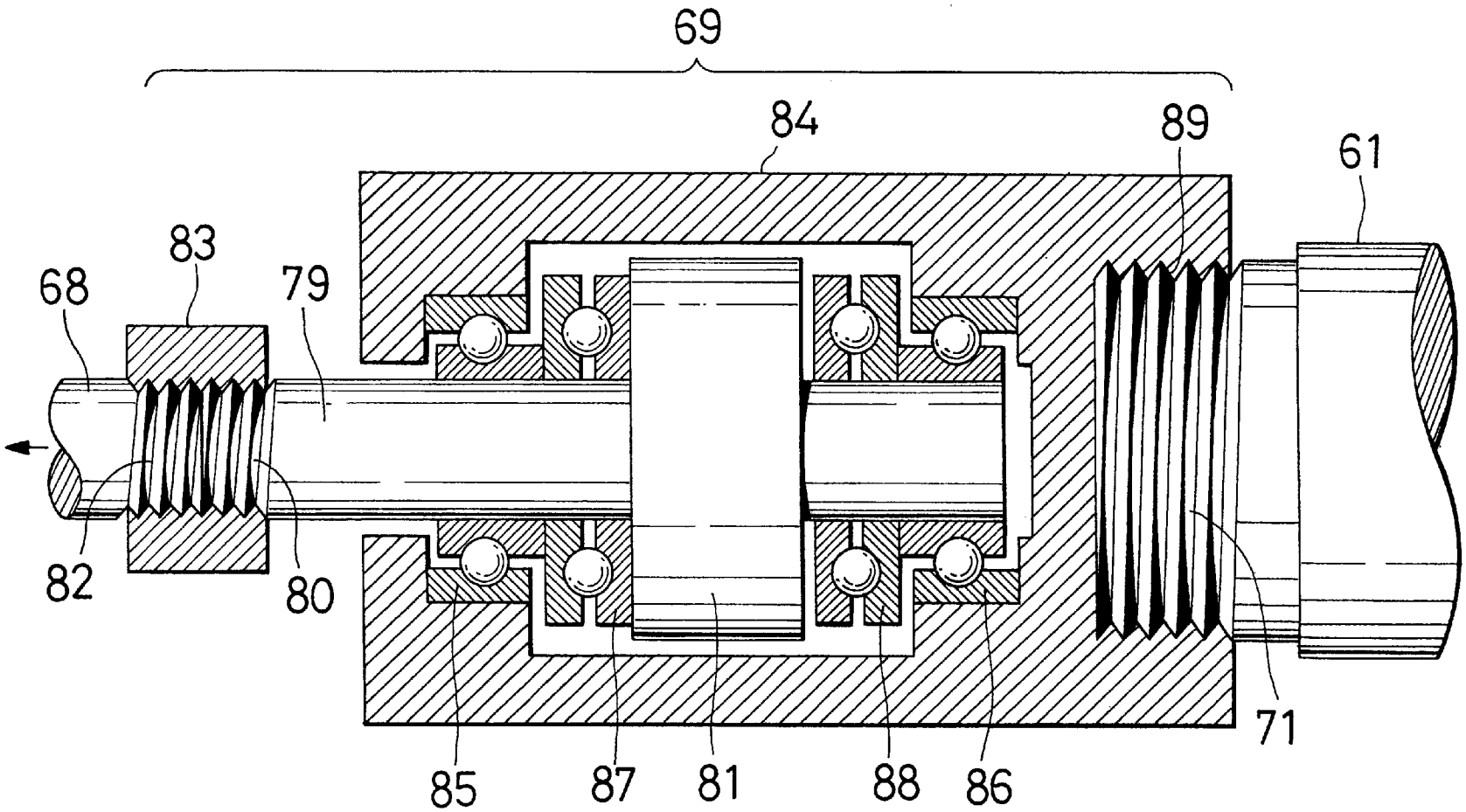
FIG. 5 is a schematic centrally longitudinal end view of a load transmitting member provided in one embodiment of the inventive plastic working machine.

When the tensile load is caused to emerge on the rod 68 in contrary, the flange 81 of the loaded load transmitting rod 79 is press-fitted with the thrust ball bearing 87, the thrust ball bearing 87 is press-fitted with the radial ball bearing 85 and the radial ball bearing 85 is press-fitted with the cylinder 84 as shown in FIG. 5.

Accordingly, the tensile load emerged on the rod 68 may be transmitted to the cylinder 84 via the loaded load transmitting rod 79, the thrust ball bearing 87 and the radial ball bearing 85 and further to the tube 33 via the load application auxiliary member 61.

It is noted that tube holding and spinning means is composed of the chuck 34, the AC servo-motor 37, the decelerator 38 and the like and load applying means is composed of the hydraulic cylinder 67, the load transmitting member 69, the load application auxiliary member 61, the fastening member 62 and the like. The AC servo-motor control means 70 functions as tube holding and rotation controlling means, synchronization control means.

According to one embodiment of the inventive plastic working machine constructed as described above, the tube 33 may be spun continuously around the axis thereof, the movable stages 49 and 50 may be moved symmetrically in the radial direction of the tube 33 or the movable stage 44 may be moved in the axial direction of the tube 33 in the same time by controlling the rotation of the AC servo-motors 37, 46, 55 and 56 by the AC servo-motor control means 70.

That is, according to one embodiment of the inventive plastic working machine, the tube 33 may be worked while spinning it by spinning the tube 33 continuously around the axis thereof by controlling the rotation of the AC servo-motors 37, 46, 55 and 56 by the AC servo-motor control means 70 and by pressing the plastic working rollers 57 and 58 against the tube 33 by controlling the relative position between the plastic working rollers 57 and 58 and the tube 33.

In this case, when the movable stage 64 is fixed to the base 32 by the fixing members 65 and 66 in advance so that it will not move along the linear way rails 42 and 43, compressive load or tensile load may be applied to the tube 33 which spins continuously via the rod 68, the load transmitting member 69 and the load application auxiliary member 61 by using the hydraulic cylinder 67.

Thus, one embodiment of the inventive plastic working machine allows a tubular member having a desired thickness to be fabricated by controlling the thickness of each part of the tubular member fabricated by the spinning work by controlling hydraulic pressure of the hydraulic cylinder 67 because the tube 33 may be worked by the plastic working rollers 57 and 58 while spinning it by continuously spinning the tube 33 around the axis thereof and by applying the compressive load or the tensile load to the tube 33 along the axial direction of the tube 33.

Figure 6A:
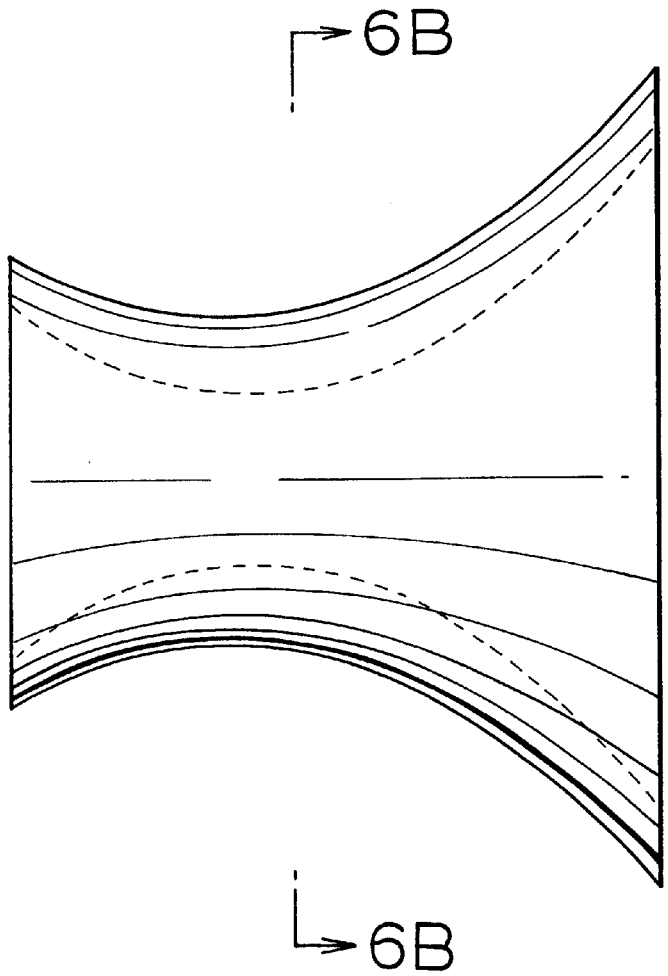
Figure 6B:
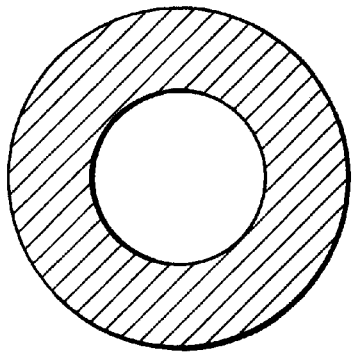
Figure 18:
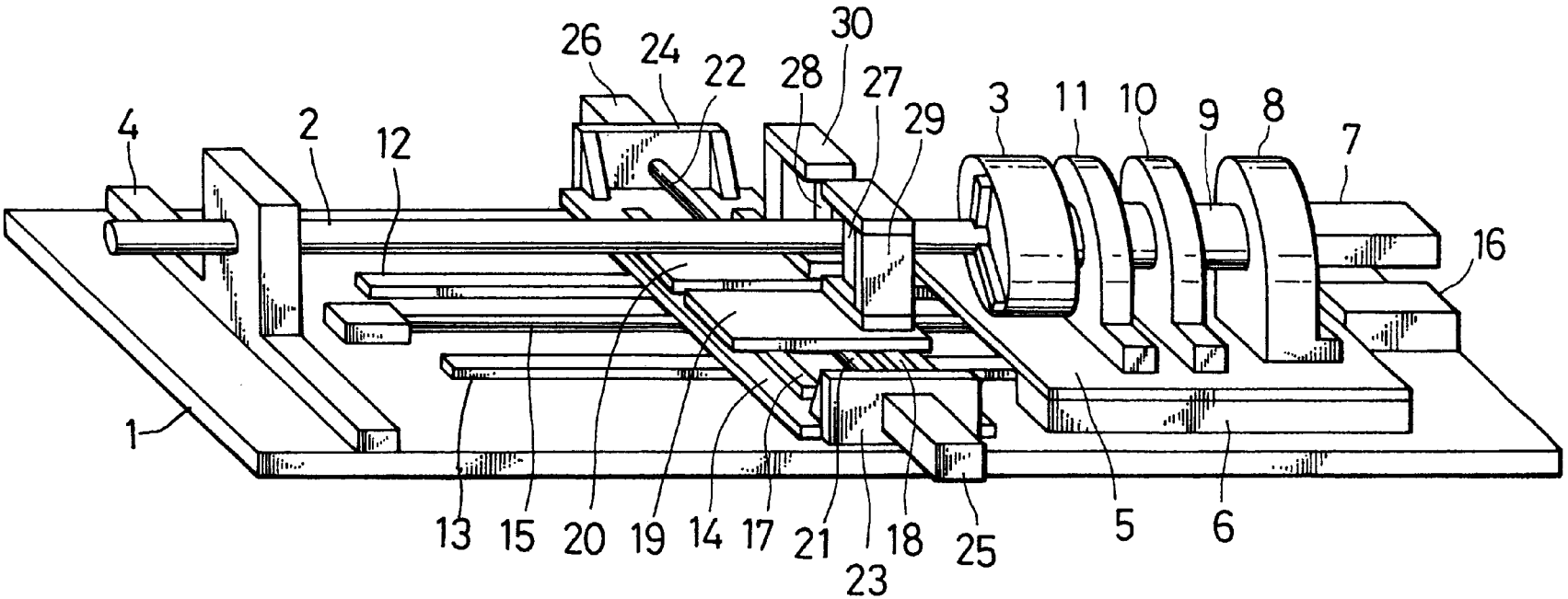
FIG. 18 is a schematic perspective view showing one example of a conventional spinning work machine.
Figure 19A:
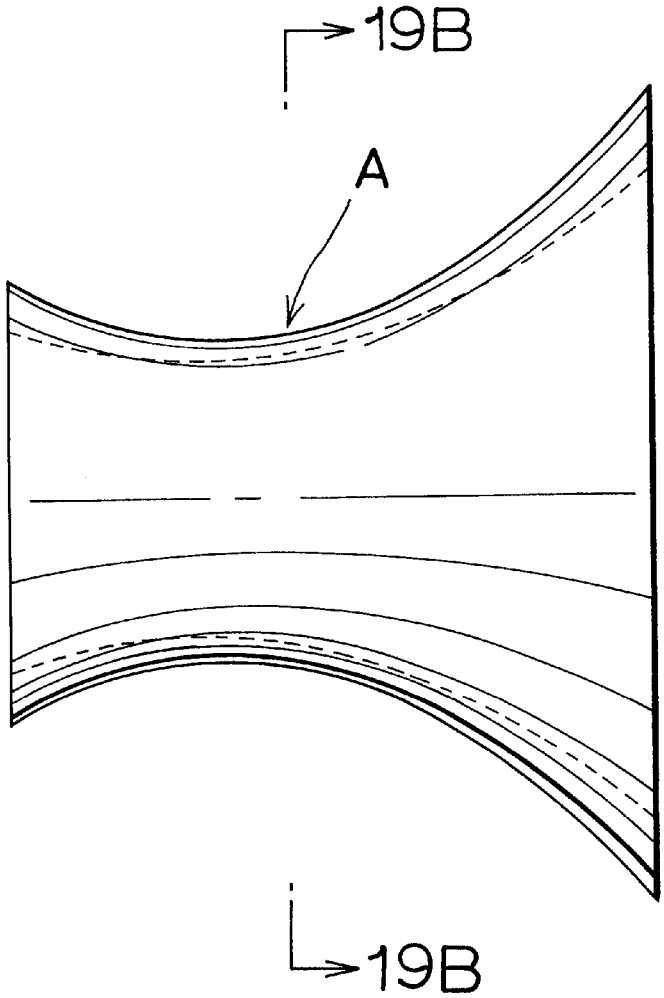
Figure 19B:
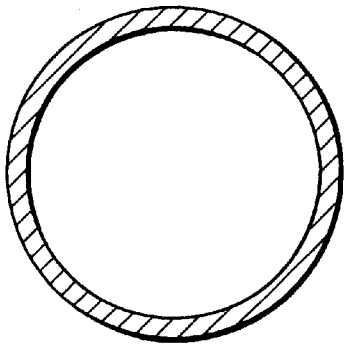

For instance, when a tubular member having an external shape as shown in FIGS. 6A and 6B is to be fabricated, there have been the problems when the conventional spinning work machine as shown in FIG. 18 is used that thickness of each part becomes thinner than the thickness thereof before the work and the part around the bottom of the concave portion indicated by an arrow A is thinned in particular as shown in FIGS. 19A and 19B. However, the thickness of the part around the bottom of the concave portion may be thickened than that before the work as shown in FIGS. 6A and 6B when one embodiment of the inventive plastic working machine is employed because the compressive load along the axial direction of the tube 33 may be applied to the tube 33 in spinning it.

Figure 7A:
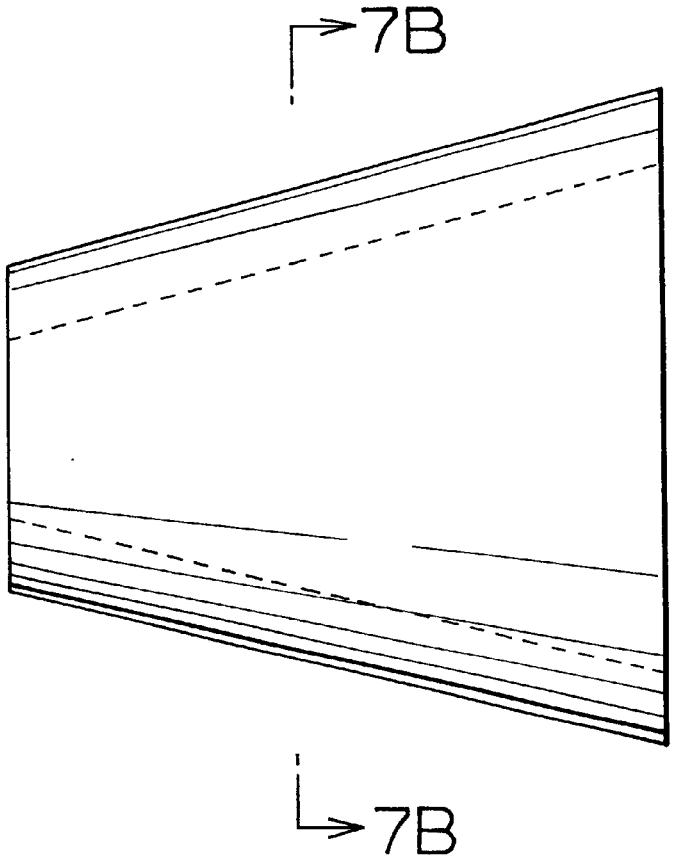
Figure 7B:
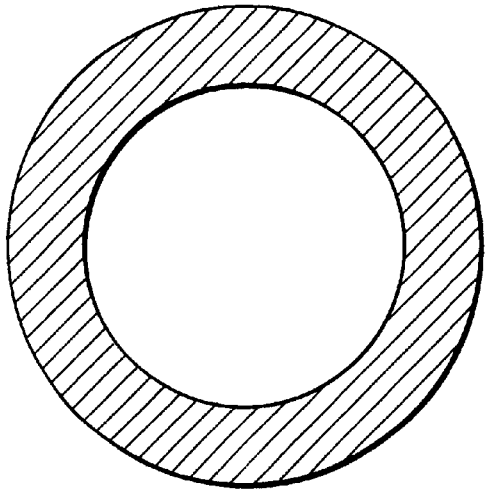
Figure 20A:
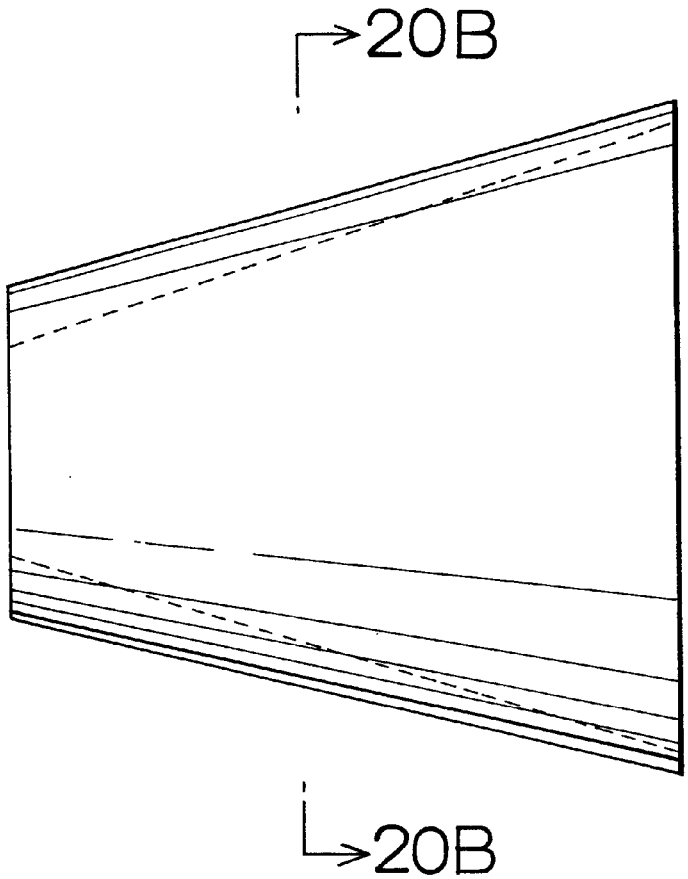
Figure 20B:
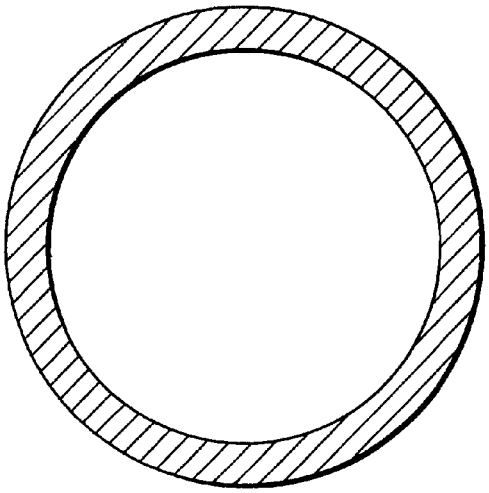

Further, when a ringed member having an external shape as shown in FIGS. 7A and 7B is to be fabricated for example, there has been a problem when the conventional spinning work machine shown in FIG. 18 is used that the smaller the sectional area, i.e., the closer to the part which must be shrunk more, the thicker the thickness becomes and that the thickness cannot be fixed as shown in FIGS. 20A and 20B. However, the use of one embodiment of the inventive plastic working machine allows the thickness to be fixed as shown in FIGS. 7A and 7B because the tensile load along the axial direction of the tube 33 may be applied to the tube 33 in the spinning work.

Further, according to one embodiment of the inventive plastic working machine, the tube 33 may be fixed at a desired turn angle, the movable stages 49 and 50 may be moved symmetrically in the radial direction of the tube 33 and the movable stage 44 may be moved in the axial direction of the tube 33 by controlling the rotation of the AC servo-motors 37, 46, 55 and 56 by the AC servo-motor control means 70.

Figure 8:
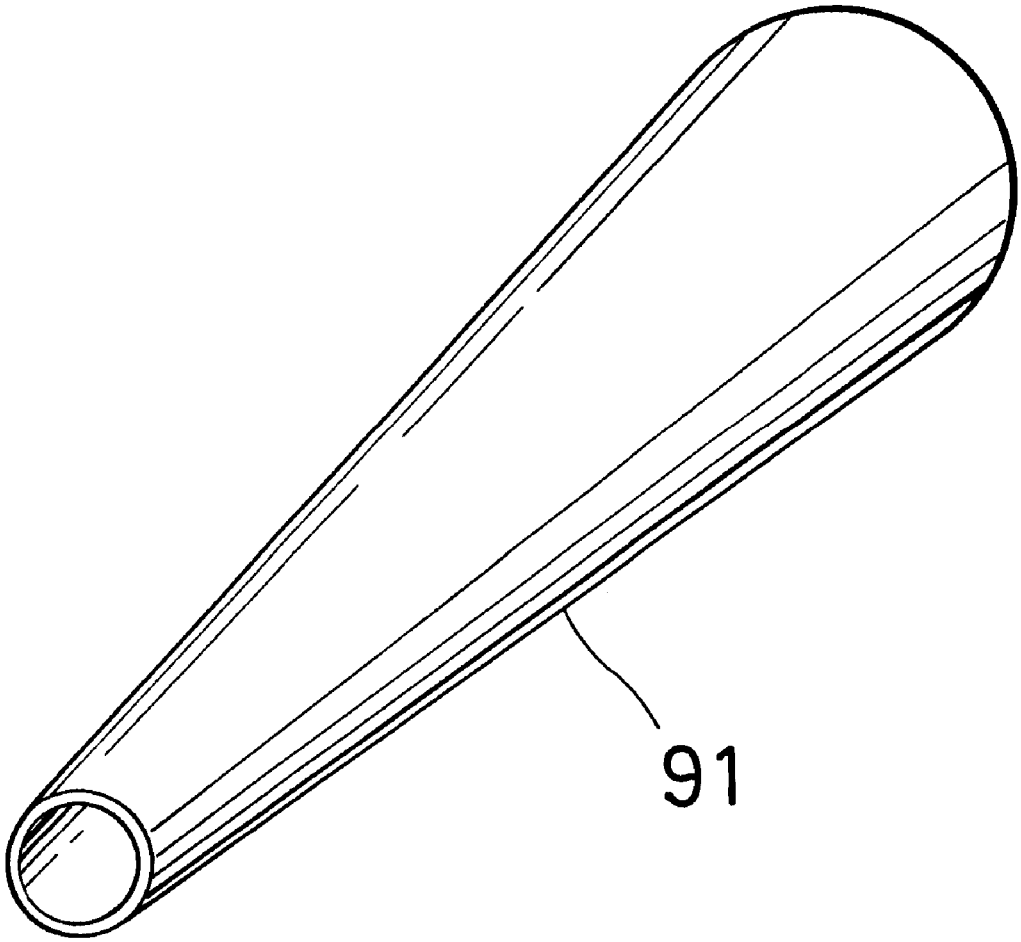
FIG. 8 is a schematic perspective view of a tapered tube whose sectional profile is circular to be used to fabricate a tapered tube whose sectional profile is square by employing one embodiment of the inventive plastic working machine.
Figure 9:
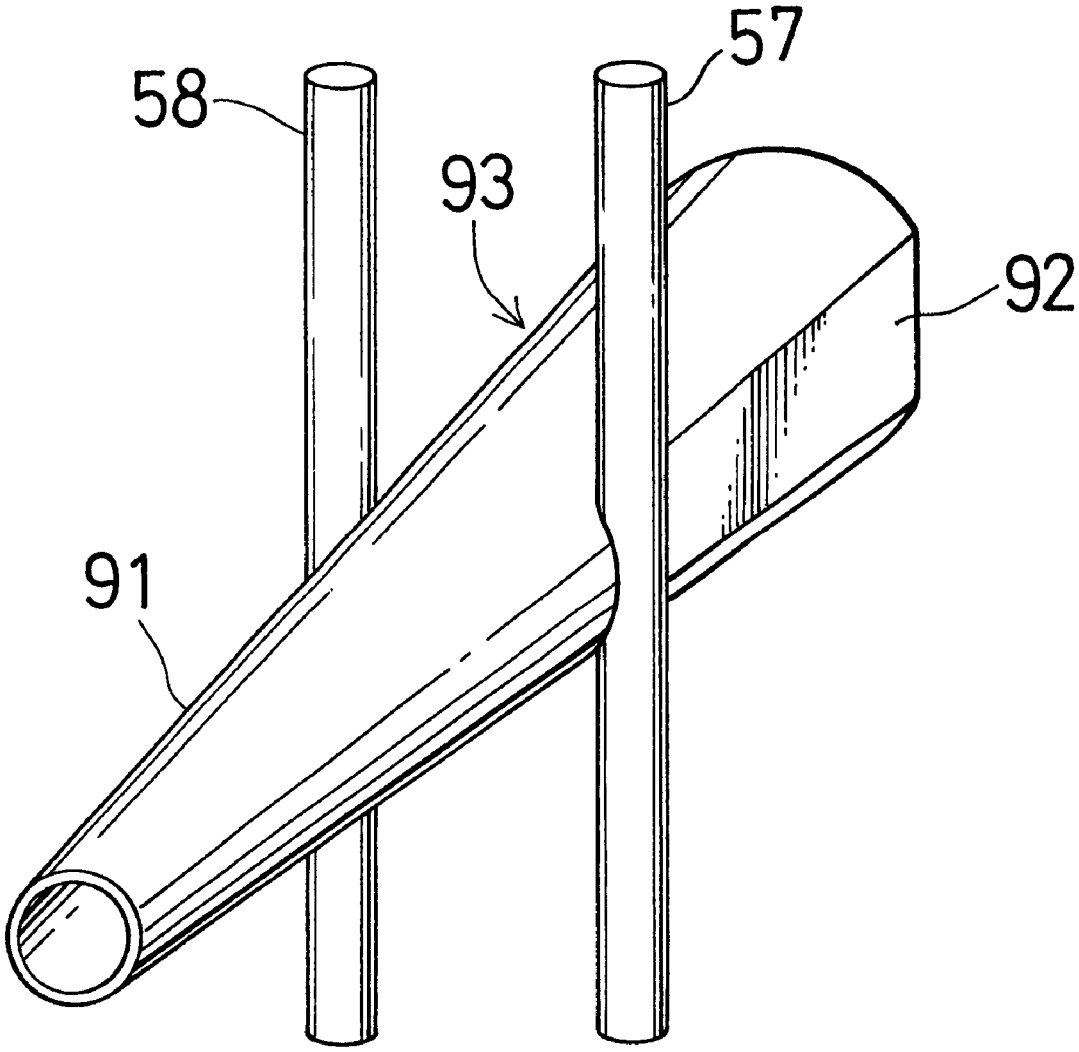
FIG. 9 is a schematic perspective view for explaining a process for roll-molding a tapered tube whose sectional profile is circular to fabricate a tapered tube whose sectional profile is square by employing one embodiment of the inventive plastic working machine.

Then, a tapered tube 91 whose sectional profile is circular as shown in FIG. 8 is used as a tube, is fixed with 0° of turn angle, the movable stages 49 and 50 are moved symmetrically in the radial direction of the tube 33 and the movable stage 44 is moved in the axial direction of the tapered tube 91 to press the plastic working rollers 57 and 58 against the tapered tube 91 to roll-mold and to form two flat planes 92 and 93 facing to each other as shown in FIG. 9.

Figure 10:
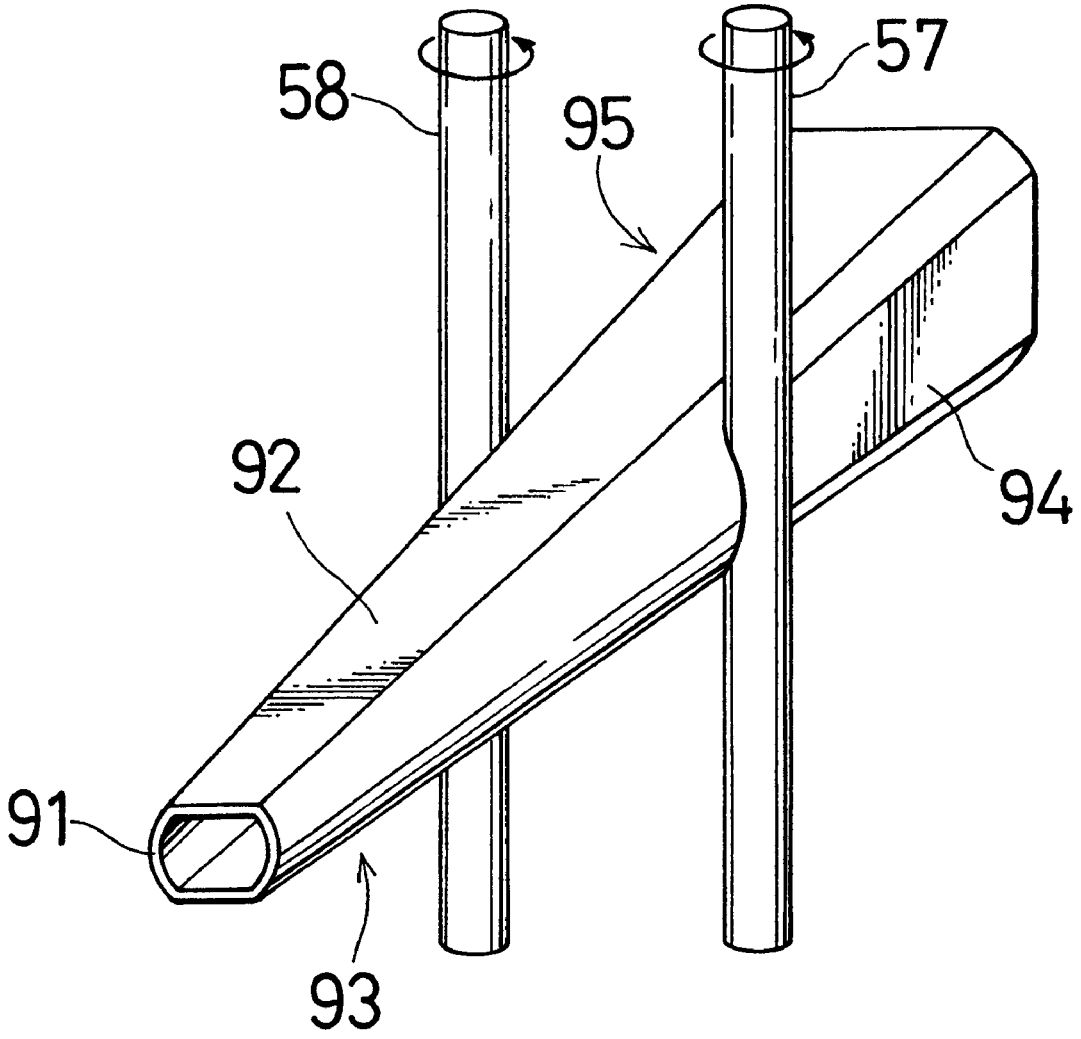
FIG. 10 is a schematic perspective view for explaining a process for roll-molding a tapered tube whose sectional profile is circular to fabricate a tapered tube whose sectional profile is square by employing one embodiment of the inventive plastic working machine.

Next, the tapered tube 91 is fixed with 90° of turn angle, the movable stages 49 and 50 are moved symmetrically in the radial direction of the tube 33 and the movable stage 44 is moved in the axial direction of the tapered tube 91 to press the plastic working rollers 57 and 58 against the tapered tube 91 to roll-mold and to form two flat planes 94 and 95 facing to each other between the flat planes 92 and 93 as shown in FIG. 10.

Figure 11:
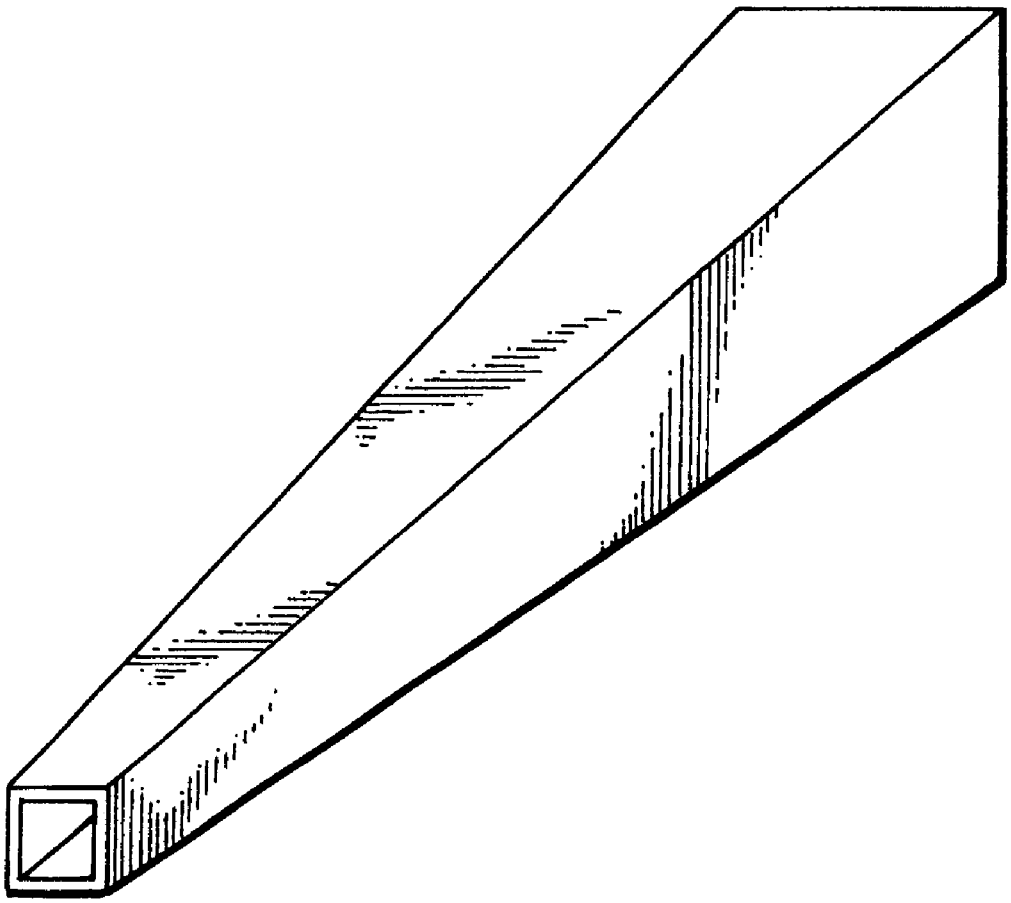
FIG. 11 is a schematic perspective view showing the tapered tube whose sectional profile is square fabricated by roll-molding the tapered tube whose sectional profile is circular by employing one embodiment of the inventive plastic working machine.

Thus, a tapered tube whose sectional profile is square as shown in FIG. 11, which could not be fabricated by the conventional spinning work machine shown in FIG. 18, may be fabricated by repeating the roll-molding process as described above.

Further, the tapered tube 91 whose sectional profile is circular as shown in FIG. 8 is used, is fixed with 0° of turn angle, the movable stages 49 and 50 are moved symmetrically in the radial direction of the tube 33 and the movable stage 44 is moved in the axial direction of the tapered tube 91 to press the plastic working rollers 57 and 58 against the tapered tube 91 to roll-mold and to form first and second flat planes facing to each other.

Next, the tapered tube 91 is fixed with 60° of turn angle, the movable stages 49 and 50 are moved symmetrically in the radial direction of the tube 33 and the movable stage 44 is moved in the axial direction of the tube 33 to press the plastic working rollers 57 and 58 against the tapered tube 91 to roll-mold and to form third and fourth flat planes facing to each other.

Then, the tapered tube 91 is fixed with 120° of turn angle, the movable stages 49 and 50 are moved symmetrically in the radial direction of the tube 33 and the movable stage 44 is moved in the axial direction of the tube 33 to press the plastic working rollers 57 and 58 against the tapered tube 91 to roll-mold and to form fifth and sixth flat planes facing to each other.

Figure 12:
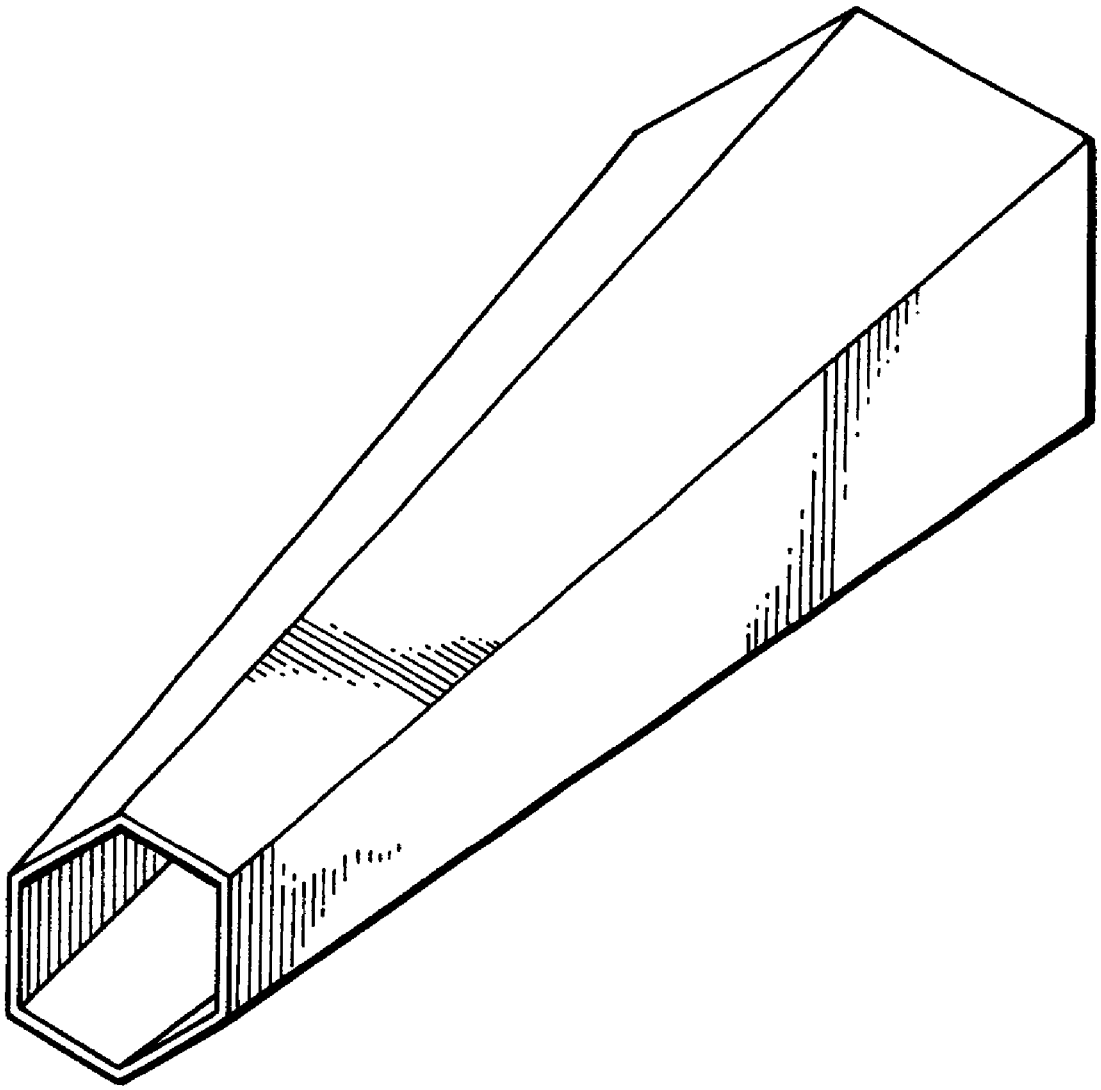
FIG. 12 is a schematic perspective view showing a tapered tube whose sectional profile is hexagonal fabricated by roll-molding the tapered tube whose sectional profile is circular by employing one embodiment of the inventive plastic working machine.

A tapered tube whose sectional profile is hexagonal as shown in FIG. 12, which could not be fabricated by the conventional spinning work machine shown in FIG. 18, may be fabricated by repeating the roll-molding process as described above.

Figure 13A:
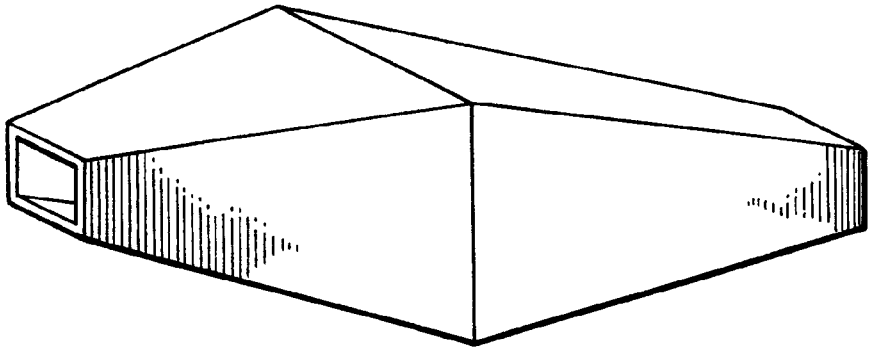
FIGS. 13A through 13C are schematic perspective views showing an example of a tubular member which can be fabricated by employing one embodiment of the inventive plastic working machine.
Figure 13B:
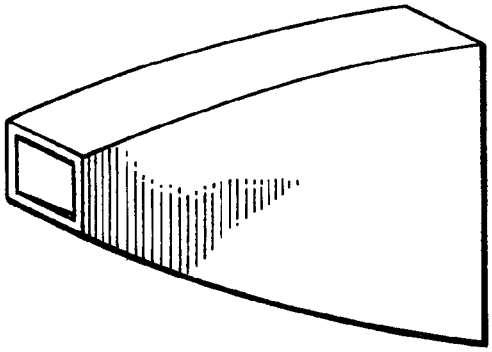
Figure 13C:
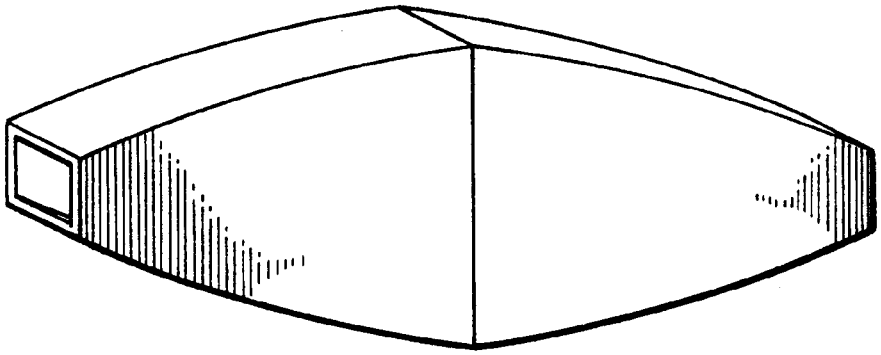
Figure 14A:
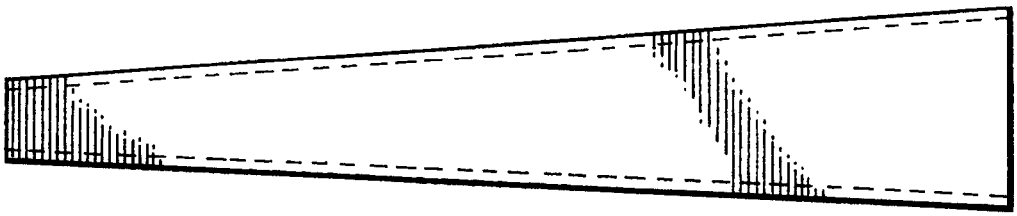
FIGS. 14A through 14C show an example of a tubular member which can be fabricated by employing one embodiment of the inventive plastic working machine.
Figure 14B:
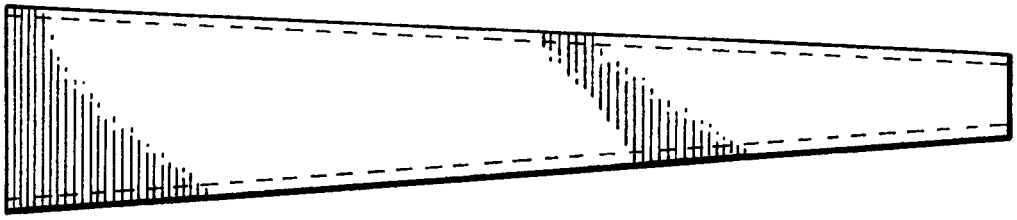
Figure 14C:
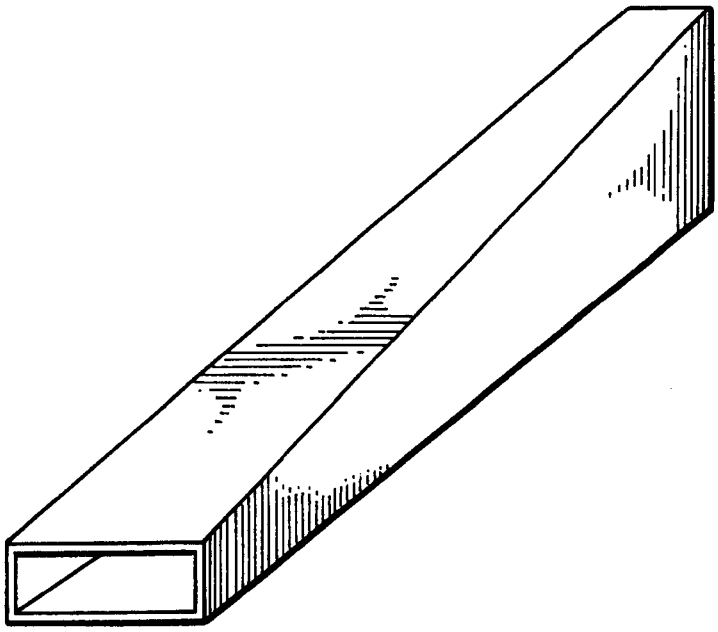
Figure 15A:
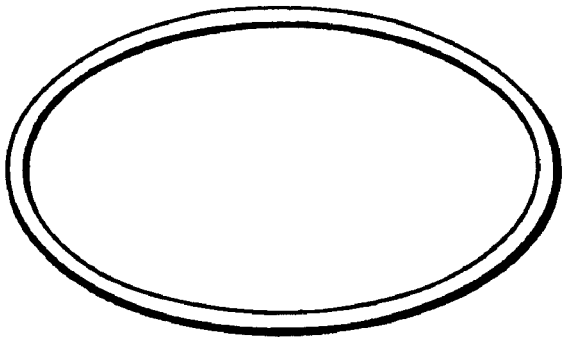
FIGS. 15A through 15C are schematic side views showing examples of tubular members which can be fabricated by employing one embodiment of the inventive plastic working machine.
Figure 15B:
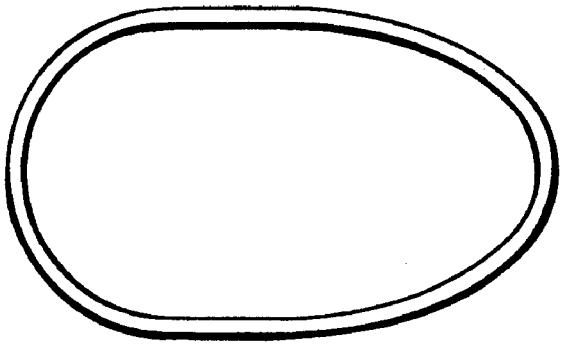
Figure 15C:
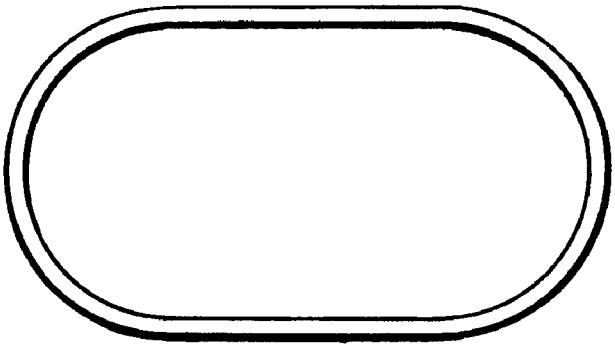

Beside them, tubular members having shapes as shown in schematic perspective views in FIGS. 13A through 13C, a tubular member as shown in schematic front, schematic plan and schematic perspective views in FIGS. 14A through 14C and tubular members having shapes as shown schematic side views in FIGS. 15A through 15C, which could not be fabricated by the conventional spinning work machine shown in FIG. 18, may be fabricated.

However, the tube 33 must be roll-molded every time when the turn angle of the tube 33 is changed bit by bit when the tubular members having the shapes as shown in the schematic side views in FIGS. 15A through 15C, respectively.

Thus, one embodiment of the inventive plastic working machine allows the tubular members having various shapes whose sectional profile is not axially symmetrical, which could not be fabricated by the conventional spinning work machine shown in FIG. 18, to be fabricated because it can execute the process of roll-molding the tube by the plastic working rollers 57 and 58 while holding the tube at a desired turn angle.

Further, according to one embodiment of the inventive plastic working machine, the tube 33 may be turned around the axis thereof by controlling the rotation of the AC servo-motors 37, 46, 55 and 56 by the AC servo-motor control means 70, the movable stages 49 and 50 may be moved symmetrically in the radial direction of the tube 33, the movable stage 44 may be moved in the axial direction of the tube 33 and the turn angle of the tube 33 may be synchronized with the position, in the axial direction of the tube 33, of the plastic working rollers 57 and 58.

Figure 16:
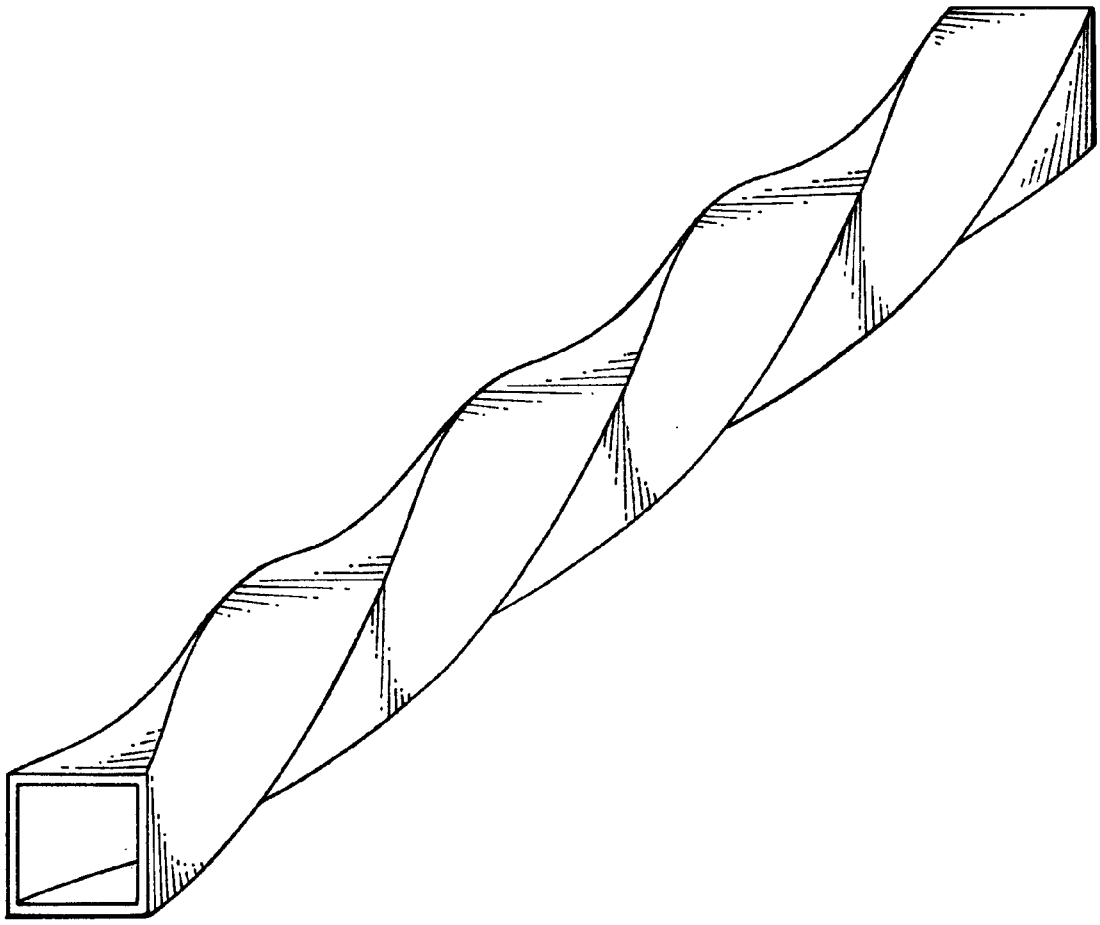
FIG. 16 is a schematic perspective view showing an example of a twisted tube whose sectional profile is square which can be fabricated by employing one embodiment of the inventive plastic working machine.

Then, when the tube 33 is turned around the axis thereof, the movable stages 49 and 50 is moved symmetrically in the radial direction of the tube 33, the movable stage 44 is moved in the axial direction of the tube 33 and the turn angle of the tube 33 is synchronized with the position, in the axial direction of the tube 33, of the plastic working rollers 57 and 58, a twisted tube whose sectional profile is polygonal, e.g., square as shown in FIG. 16, may be fabricated.

When the tapered tube whose sectional profile is circular as shown in FIG. 8 is used as the tube, a twisted tapered tube whose sectional profile is polygonal, e.g., square, may be fabricated.

Thus, the twisted tubes having various sectional profile, which could not be fabricated by the conventional spinning work machine shown in FIG. 18, may be fabricated by one embodiment of the inventive plastic working machine because it allows the tube 33 to be plastically worked by the plastic working rollers 57 and 58 while spinning the tube 33 and synchronizing the turn angle of the tube 33 with the position, in the axial direction of the tube 33, of the plastic working rollers 57 and 58.

Figure 17:
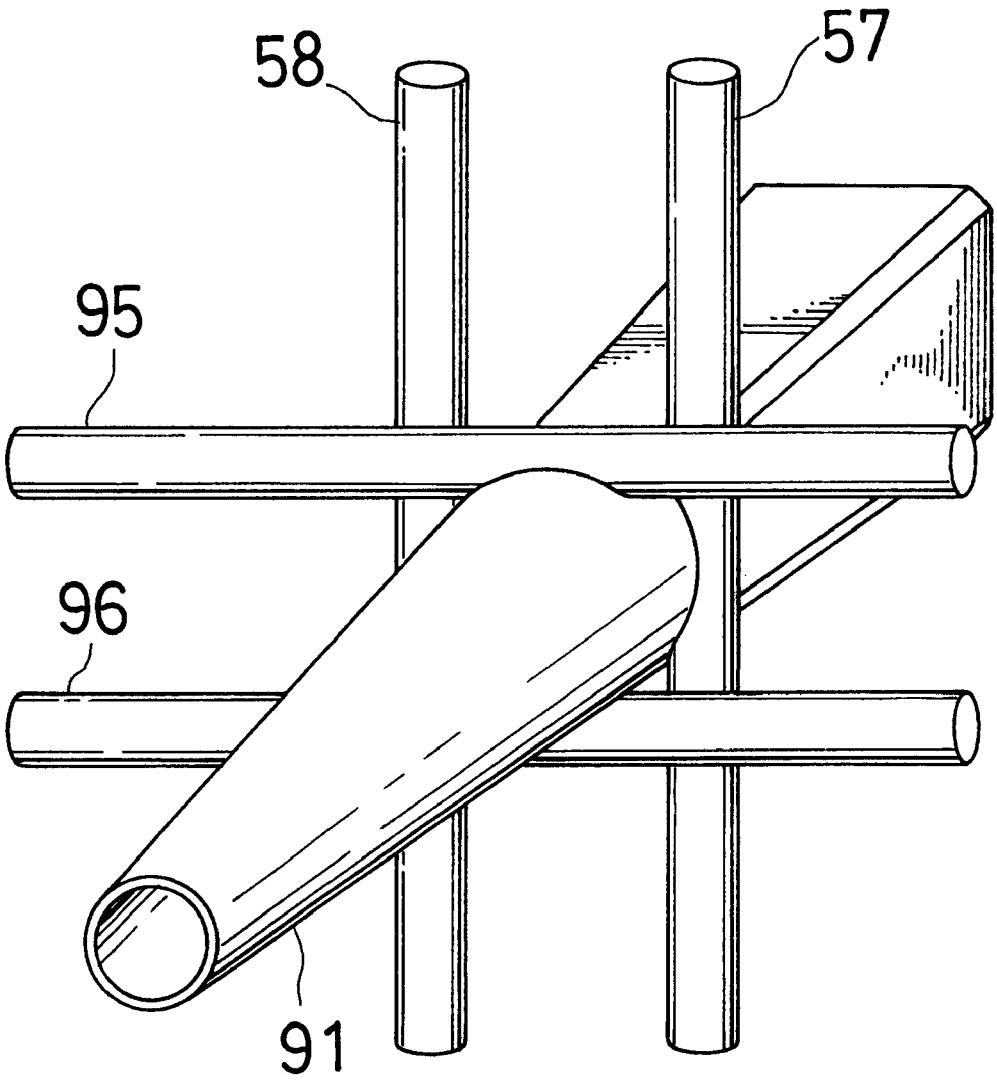
FIG. 17 is a schematic perspective view for explaining another embodiment of the inventive plastic working machine.

It is noted that although the pair of plastic working rollers 57 and 58 have been provided in one embodiment of the inventive plastic working machine, it is possible to provide the pair of plastic working rollers 57 and 58 facing to each other and a pair of plastic working rollers 95 and 96 whose axial direction cross at right angles with the pair of plastic working rollers 57 and 58 as shown in FIG. 17 so that these plastic working rollers 57, 58, 95 and 96 can be moved in the radial and axial directions of the tube 33.

In such a case, the tapered tube whose sectional profile is square as shown in FIG. 11 may be fabricated in the manner as shown in FIG. 17, thus quickening the working speed. It is noted that it is of course possible to provide three or more pairs of plastic working rollers facing to each other and movable in the radial and axial directions of the tube.

Further, although the case when the AC servo-motors 37, 46, 55 and 56 are provided as the motor for spinning the tube 33 and the motors for moving the movable stages 44, 49 and 50 has been explained in one embodiment of the inventive plastic working machine, the plastic working machine may be arranged so as to use a DC servo-motor, a DD servo-motor, a stepping motor or the like instead of the AC servo-motors.

Still more, the case when the decelerator 38 for decelerating the rotation of the AC servo-motor 37 has been explained in one embodiment of the inventive plastic working machine, the plastic working machine may be arranged so as not to provide the decelerator 38.

The present application includes the declaration of priority of Japanese Patent Application No. Hei. 10-36453 filed on Feb. 18, 1998 and the contents of disclosure thereof composes part of the present application as it is.

It is to be understood that the terminology and the descriptions employed herein have been employed solely for the purpose of explaining one embodiment of the invention and do not limit the invention. It is also to be understood that any designing changes may be made without departing from the spirit or the scope of the following claims.

What is claimed is:

1. A plastic working method for plastically working a tube by employing tube holding and spinning means for holding and spinning the plastically workable tube around the axis of said tube and first and second plastic working tools which face to each other so as to pinch said tube in the radial direction of said tube and which are movable along the radial and axial directions of said tube while being pressed against said tube;

said plastic working method comprising a step of plastically working said tube by said first and second plastic working tools by continuously spinning said tube around the axis thereof and by applying compressive load or tensile load along the axial direction of said tube to said tube.

2. The plastic working method according to claim 1, wherein said first and second plastic working tools comprise rollers which are pressed against said tube.

3. A plastic working machine, comprising tube holding and spinning means for holding and spinning a plastically workable tube around the axis of said tube and first and second plastic working tools which face to each other so as to pinch said tube in the radial direction of said tube and which are movable along the radial and axial directions of said tube while being pressed against said tube;

said plastic working machine further comprising load applying means for applying compressive load or tensile load along the axial direction of said tube to said tube.

4. The plastic working machine according to claim 3, wherein said load applying means comprises:

load application auxiliary member made from a long cylindrical member;

a fastening member for fastening and fixing said tube at one end of said load application auxiliary member in the longitudinal direction there of;

a cylinder fixed to the other end of said load application auxiliary member;

a loaded load transmitting member whose one end is stored within said cylinder and to which compressive load or tensile load in the axial direction of said load application auxiliary member is applied at the other end; and bearings for connecting said loaded load transmitting member with said cylinder so that said loaded load transmitting member moves in the axial direction of said load application auxiliary member by receiving said compressive load or tensile load without interfering the turn of said cylinder.

5. The plastic working machine according to claim 3, wherein said first and second plastic working tools comprise rollers which are pressed against said tube.

6. The plastic working machine according to claim 3, further comprising third and fourth plastic working tools which face to each other so as to pinch said tube in the radial direction of said tube and which are movable along the radial and axial directions of said tube while being pressed against said tube at the position different from the position where said tube is pressed by said first and second plastic working tools.

7. A plastic working method for plastically working a tube by employing tube holding and spinning means for holding and spinning the plastically workable tube around the axis of said tube and first and second plastic working tools which face to each other so as to pinch said tube in the radial direction of said tube and which are movable along the radial and axial directions of said tube while being pressed against said tube;

said plastic working method comprising a step of plastically working said tube by said first and second plastic working tools by holding said tube at a desired turn angle.

8. The plastic working method according to claim 7, wherein said first and second plastic working tools comprise rollers which are pressed against said tube.

9. The plastic working method according to claim 7, wherein said tube is a tapered tube whose section is circular and a tapered tube whose section is rectangular is molded by holding said tube at a plurality of turn angles and by executing the step of plastically molding said tube by said first and second plastic working tools per each turn angle.

10. A plastic working machine, comprising tube holding and spinning means for holding and spinning a plastically workable tube around the axis of said tube and first and second plastic working tools which face to each other so as to pinch said tube in the radial direction of said tube and which are movable along the radial and axial directions of said tube while being pressed against said tube;

said plastic working machine further comprising tube holding and spinning control means for controlling said tube holding and spinning means so as to hold said tube at a desired turn angle.

11. The plastic working machine according to claim 10, wherein said machine further includes load applying means comprising:

load application auxiliary member made from a long cylindrical member;

a fastening member for fastening and fixing said tube at one end of said load application auxiliary member in the longitudinal direction thereof;

a cylinder fixed to the other end of said load application auxiliary member;

a loaded load transmitting member whose one end is stored within said cylinder and to which compressive load or tensile load in the axial direction of said load application auxiliary member is applied at the other end; and bearings for connecting said loaded load transmitting member with said cylinder so that said loaded load transmitting member moves in the axial direction of said load application auxiliary member by receiving said compressive load or tensile load without interfering the turn of said cylinder.

12. The plastic working machine according to claim 10, wherein said first and second plastic working tools comprise rollers which are pressed against said tube.

13. The plastic working machine according to claim 10, further comprising third and fourth plastic working tools which face to each other so as to pinch said tube in the radial direction of said tube and which are movable along the radial and axial directions of said tube while being pressed against said tube at the position different from the position where said tube is dressed by said first and second plastic working tools.

14. A plastic working method for plastically working a tube by employing tube holding and spinning means for holding and spinning the plastically workable tube around the axis of said tube and first and second plastic working tools which face to each other so as to pinch said tube in the radial direction of said tube and which are movable along the radial and axial directions of said tube while being pressed against said tube;

said plastic working method comprising a step of plastically working said tube by said first and second plastic working tools by spinning said tube around the axis of said tube and by synchronizing the turn angle of said tube with the position of said first and second plastic working tools in the axial direction of said tube.

15. The plastic working method according to claim 14, wherein said first and second plastic working tools comprise rollers which are pressed against said tube.

16. The plastic working method according to claim 14, wherein said tube is a tube whose section is circular and a twisted tube whose section is rectangular is molded.

17. A plastic working machine, comprising tube holding and spinning means for holding and spinning a plastically workable tube around the axis of said tube and first and second plastic working tools which face to each other so as to pinch said tube in the radial direction of said tube and which are movable along the radial and axial directions of said tube while being pressed against said tube;

said plastic working machine further comprising synchronization control means for synchronizing the turn angle of said tube with the position of said first and second plastic working tools in the axial direction of said tube.

18. The plastic working machine according to claim 17, wherein said machine further includes load applying means comprising:

load application auxiliary member made from a long cylindrical member;

a fastening member for fastening and fixing said tube at one end of said load application auxiliary member in the longitudinal direction thereof;

a cylinder fixed to the other end of said load application auxiliary member;

a loaded load transmitting member whose one end is stored within said cylinder and to which compressive load or tensile load in the axial direction of said load application auxiliary member is applied at the other end; and bearings for connecting said loaded load transmitting member with said cylinder so that said loaded load transmitting member moves in the axial direction of said load application auxiliary member by receiving said compressive load or tensile load without interfering the turn of said cylinder.

19. The plastic working machine according to claim 17, wherein said first and second plastic working tools comprise rollers which are pressed against said tube.

20. The plastic working machine according to claim 17, further comprising third and fourth plastic working tools which face to each other so as to pinch said tube in the radial direction of said tube and which are movable along the radial and axial directions of said tube while being pressed against said tube at the position different from the position where said tube is pressed by said first and second plastic working tools.

* * * * *